US005317791A

United States Patent [19]

Adam

[11] Patent Number: 5,317,791

[45] Date of Patent: Jun. 7, 1994

[54] APPARATUS FOR PRODUCING SLUB EFFECTS IN YARN STRANDS

[76] Inventor: Adolf Adam, 121 Valley Forge Dr., Greer, S.C. 23650

[21] Appl. No.: 36,401

[22] Filed: Mar. 24, 1993

[51] Int. Cl.[5] ..... D02G 3/24; D01H 13/02

[52] U.S. Cl. ..... 28/252; 28/258; 28/271; 57/91

[58] Field of Search ..... 28/219, 247, 252, 253, 28/258, 266, 278, 279, 280, 281; 57/6, 13, 58.36, 91, 239, 352; 264/290.7

[56] References Cited

U.S. PATENT DOCUMENTS

| | | | |
|---|---|---|---|
| 1,898,085 | 2/1933 | Dreyfus et al. | 57/91 |
| 3,218,654 | 11/1965 | Yano et al. | 28/252 X |
| 4,080,771 | 3/1978 | Griset, Jr. | 57/91 X |
| 4,305,245 | 12/1981 | Echenbach | 57/91 X |
| 4,343,071 | 8/1982 | Schroder | 28/258 X |
| 4,899,426 | 2/1990 | Hand | 28/252 |

FOREIGN PATENT DOCUMENTS

| | | | |
|---|---|---|---|
| 570923 | 2/1933 | Fed. Rep. of Germany | 57/91 |
| 7041063 | 12/1970 | Japan | 28/253 |
| 500307 | 1/1971 | Switzerland | 28/252 |
| 1481287 | 5/1989 | U.S.S.R. | 57/91 |

*Primary Examiner*—Clifford D. Crowder
*Assistant Examiner*—John J. Calvert
*Attorney, Agent, or Firm*—John P. Halvonik

[57] ABSTRACT

An apparatus for air jet processing of threads of yarn to create fancy effects in yarn. The apparatus comprises at least one pair of reciprocally moving triangular profiles which move across the paths of moving yarn strands. Each triangular profile is separately mounted on a driving shaft and each moves opposite the other in order to create slack portions in the moving strand that are then taken up by an air jet to create slub lengths. The overall yarn processing system contemplates at least one pair of first and second feed rolls that feed lengths of yarn to air jet machines.

4 Claims, 6 Drawing Sheets

APPARATUS FOR PRODUCING SLUB EFFECTS IN YARN STRANDS

BACKGROUND OF THE INVENTION

1. Field of Invention

The invention relates to the field of air texturing machines and in particular to an arrangement for producing slubbing effects in yarn through an add on apparatus that attaches to existing yarn processing machines. More specifically, the add on apparatus utilizes a pair of moving triangular profile portions each of which is mounted on a reciprocating driving rod in connection with each feed roll in order to produce special effects in yarn e.g. slub yarn and effect yarn. Special effects in yarn include variation in size and color, slub lengths are single strands that have these effects and effect yarn includes two or more colors of yarn.

2. Description of the Prior Art

While there are air jet texturizing apparatus that do exist and produce the types of special yarns described, none that applicant is aware of provide an easily attached system of mounted triangular profiles that may be retrofitted onto existing yarn processing machines in order to create slub effects. Moreover, none utilize a system of reciprocally moving mounted triangular profiles (most likely two) that move opposite one another to interact with yarn strands in order to create slub lengths.

SUMMARY OF THE INVENTION

The invention is a process and an apparatus for producing special effects in yarn. The effects in the yarn strands are produced by an air jet machine which intakes various lengths of slack in yarn strands fed to the air jet by feed rolls. The device herein described may be retrofitted onto existing feed rolls and associated air jets on pre-existing devices. In this case, a pair of triangular profile portions mounted on reciprocally moving driving rods are retrofitted onto the existing machine in order to interact with the moving strands and produce slack portions in the strand which are subsequently inletted into the air jet where they become slub lengths.

Each moving triangular profile interacts with one feed roll. In the typically two feed-roll machines contemplated, two moving triangular profiles move opposite one another producing slub lengths in the two strands. The movement of the triangular portions may be varied in order to vary the interval between the slub lengths produced. Yarn profile guides are also used in connection with each feed roll and also move in reciprocal fashion. This movement may be varied in order to vary the length of slub lengths produced.

It is an object of the invention to provide an air jet texturing machine for creating slub lengths that may be quickly and inexpensively retrofitted onto existing yarn processing equipment.

Another object of the invention is to create slub effects in yarn in air texturizing processes and to be able to vary the lengths of the slubs and the intervals between the slubs.

Yet another object is to provide a slub effecting apparatus that can operate at very slow speeds or at high speeds for at least four different yarns or yarn colors.

Other objectives of the invention will become apparent to those skilled in the art once the invention has been shown and described.

DESCRIPTION OF THE PREFERRED EMBODIMENT

Figure 1:
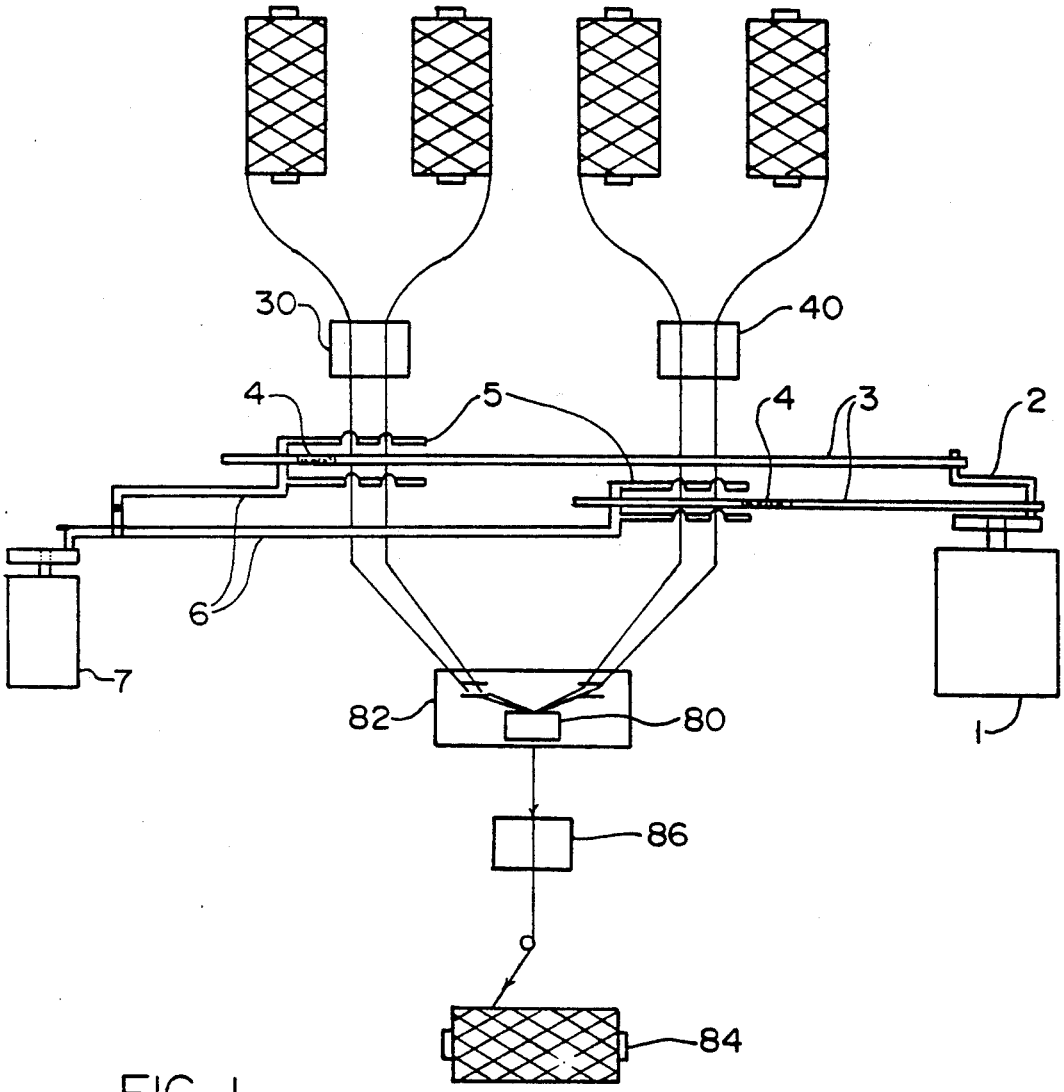
FIG. 1 shows the general schematic of the system.

Note in FIG. 1 that the schematic shows the working principle of operation rather than an actual view of the machine. Hence, the first feed roll 30 and second feed roll 40 may be above one another in the actual arrangement, they are not necessarily side by side. Separate feed rolls may be on different machines in the field. Similarly, the jet box 82, take up reel 84, drive motor and pulley 88 and moving profiles would be at various levels above and below one another. Other parts include the air jet 80, nip roll 86, finished package 87, and wetting device 90.

Figure 2:
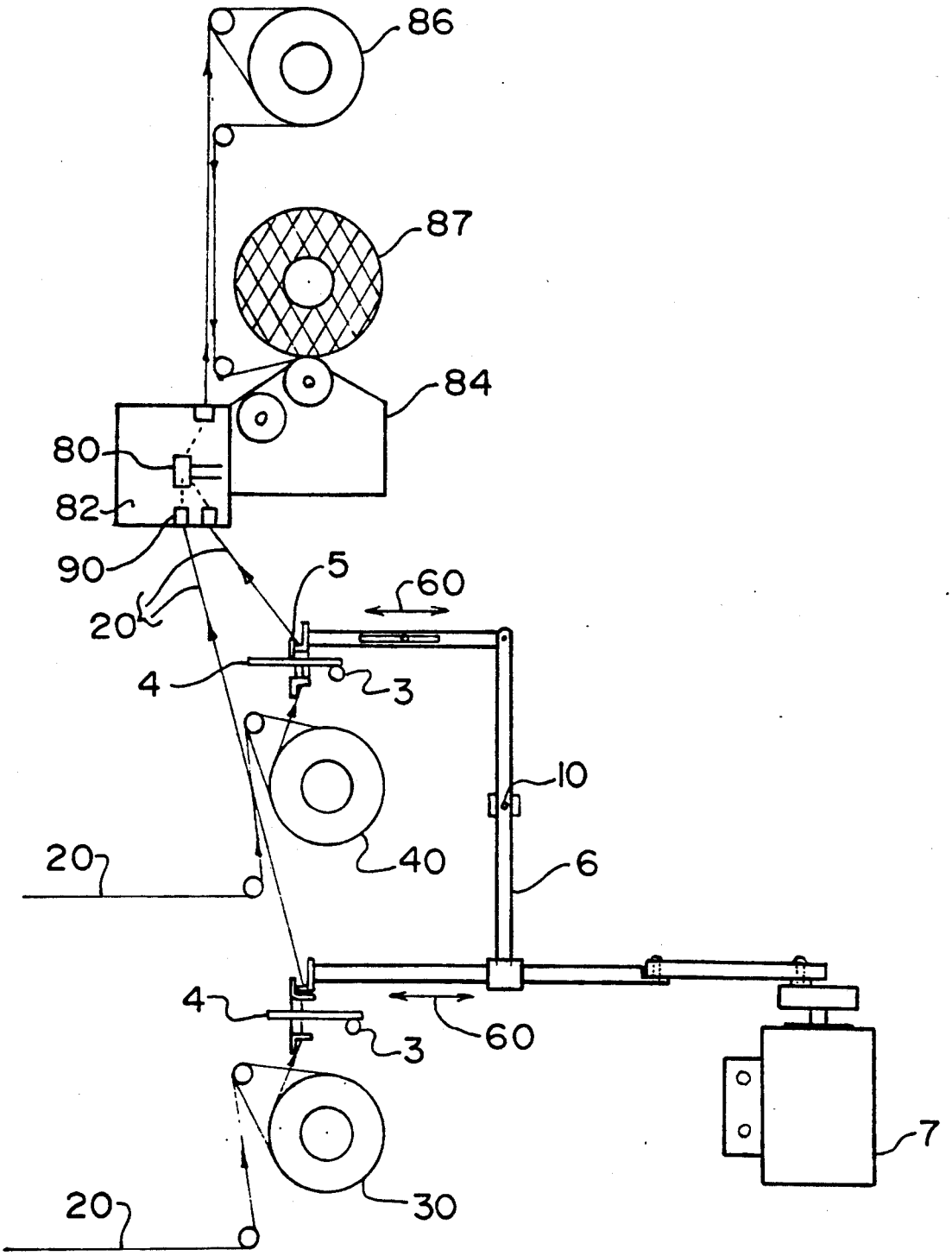
FIG. 2 side view of air texturizing machine including yarn guides.
Figure 3:
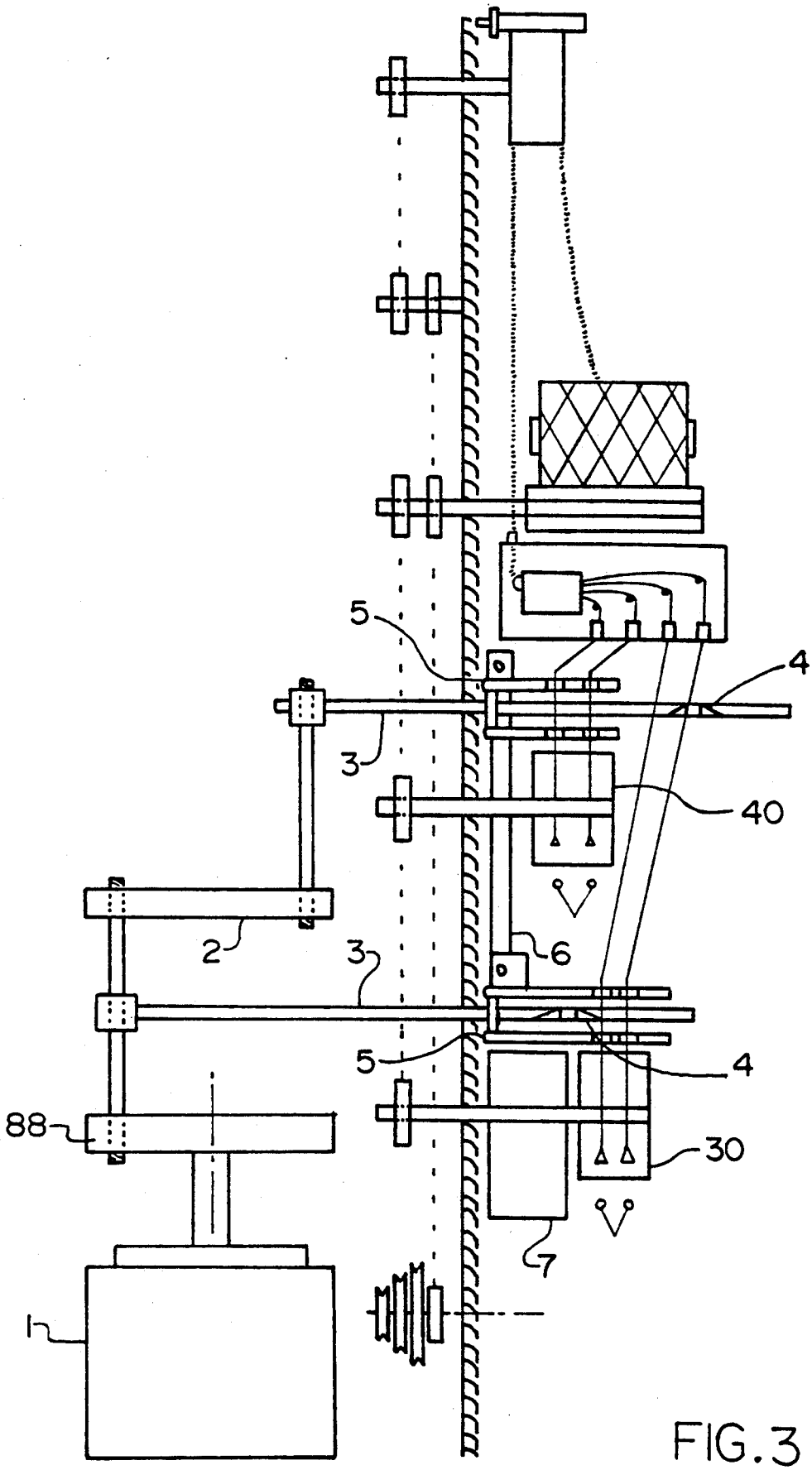
FIG. 3 Front view of schematic operation.

The invention would be used, most likely, in connection with air texturizing machines that already have at least 2 feed rolls 30 and 40. FIG. 2 shows the side view of the working apparatus.

A geared drive motor 1 moves mounting rods 3 in reciprocal relation to one another. In other words, as one rod has traveled maximum distance to the right, the other rod has traveled maximum distance to the left and vice versa (the terms right and left are chosen for convention in this example). The rods are in connection with triangular shaped portions (or profiles) 4 which are mounted on the rods. The profiles may be mounted by a pair of holes 52 placed in the rear of each triangle or by other means.

The tips of the triangular portions are so placed that they will contact a portion of a moving strand 20 of yarn as the strand comes off of one of the feed rolls. This will occur as the triangular portions move back and forth across the moving yarn strand, see FIG. 9 which illustrates the movement of a triangle profile as it interacts with the yarn strand.

Figure 4:
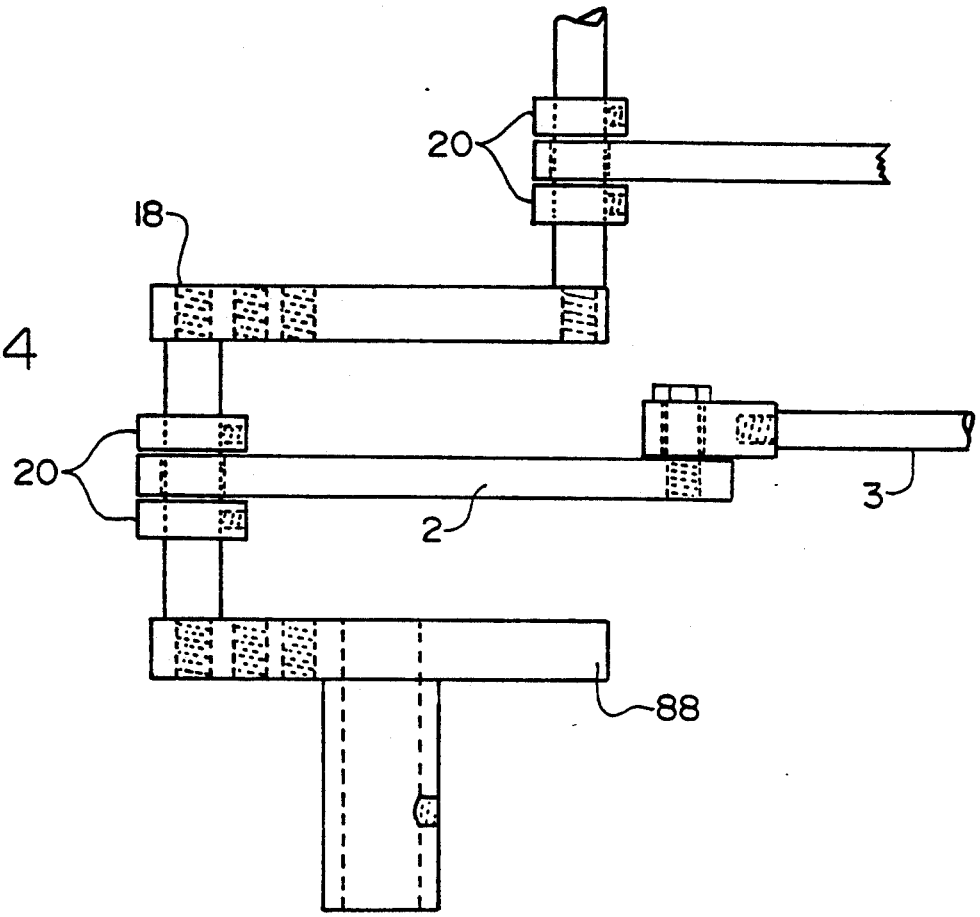
FIG. 4 Side view of mounting rod.
Figure 5:
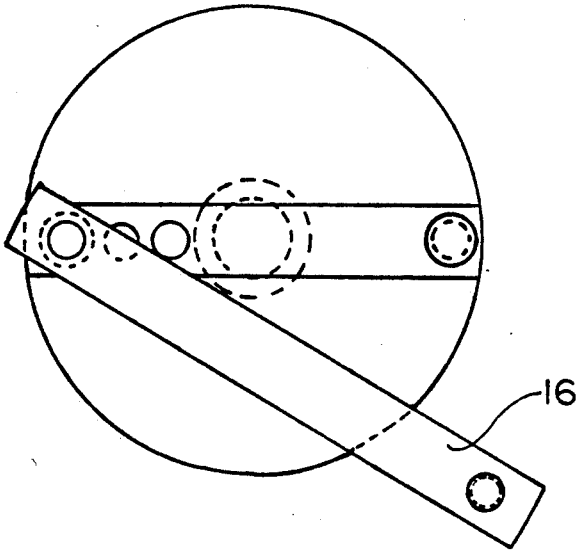
FIG. 5 Top view of mounting rod.

The rods may be mounted to the motor through a wheel and rod arrangement shown in FIGS. 4 and 5. The circular motion of the wheel is converted into reciprocal motion in the engagement rod 16. Collars 20 are used to connected the engagement rods to the mounting rods.

Adjustment holes 18 are provided in the mounting rod in order to vary the position of the mounting rod on the engagement rod so that the rod can reciprocate different distances. Other adjustment holes may be placed in the wheel for the same purpose. By varying this distance different slub lengths can be made, usually from about ¼" to 2" although greater or lesser lengths can also be made with appropriately sized wheels and rods.

Of course, other methods of producing reciprocal movement in the drive rods may be used.

In the preferred embodiment, there would be two such mounting rods with corresponding triangular portions mounted on each rod. There will be one mounting rod and triangular profile for each feed rolls used. Typical machines use two feed rolls but other numbers of feed rolls are possible without violating the spirit of the invention.

Each triangular portion comes in contact with the yarn strand once per cycle of the drive rod. When the triangular portion does contact the strand, a slack portion is created in the strand as the tip of the triangle holds it back. Eventually as the profile continues to move (each triangle is moving back and forth and in opposite relation to the other triangle) the strand will move across the tip and be released. When the slack is released, this portion is inletted into the air jet and this creates the slubbing effect on a length of yarn. It should be possible to vary the length of the interval between slubs up to at least 6 feet and probably more through the reciprocating arrangement described.

Figure 10:
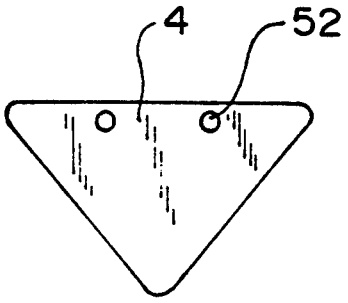
FIG. 10 Detail of triangular profile.

Each triangle profile may be mounted to the drive rod 3 through the use of mounting holes 52. These may be threaded for screws. Other means for attaching the profiles to the drive rods may be used. The tip of the triangle is preferably rounded as seen in FIG. 10. The tip is not necessarily 90°, it is preferably anywhere from 75°-120°.

In FIG. 2, the yarn guide traverse device 6 reciprocates the yarn guides 5 in order to create slubs of different lengths. Each back and forth movement of the guide will place the moving strand from the feed roll in connection with the moving triangular profile 4 once. Each time this happens, one slub length will be produced in the yarn strand. By varying the rate of the movement of the yarn guides 5A and 5B, the distance between the slubs may be varied. Note that the actual length of the slub may be changed by the distance of travel of the triangular profile 4, see arrow 62 in FIG. 9.

As seen in FIG. 2, each pair of guides 5A and 5B are in connection with a pivoting arm 6 that imparts back forth motion to the guides as it pivots upon point 10. Thus, the lower pair of guides (that pair of guides in connection with the yarn from 30) is moving to the left when the upper pair of guides (that pair in connection with yarn from 40) is moving to the right and vice versa. This sort of movement necessarily follows from the pivoting of the arm which pivots at point 10. See arrows 60 in FIG. 2 that show this movement.

Note that there are typically two yarn guides in connection with each triangle, one below 5B and one above 5A the moving triangle. There are eyelets 50 or other guide means in each guide that are used to guide the movement of the yarn.

Figure 9:
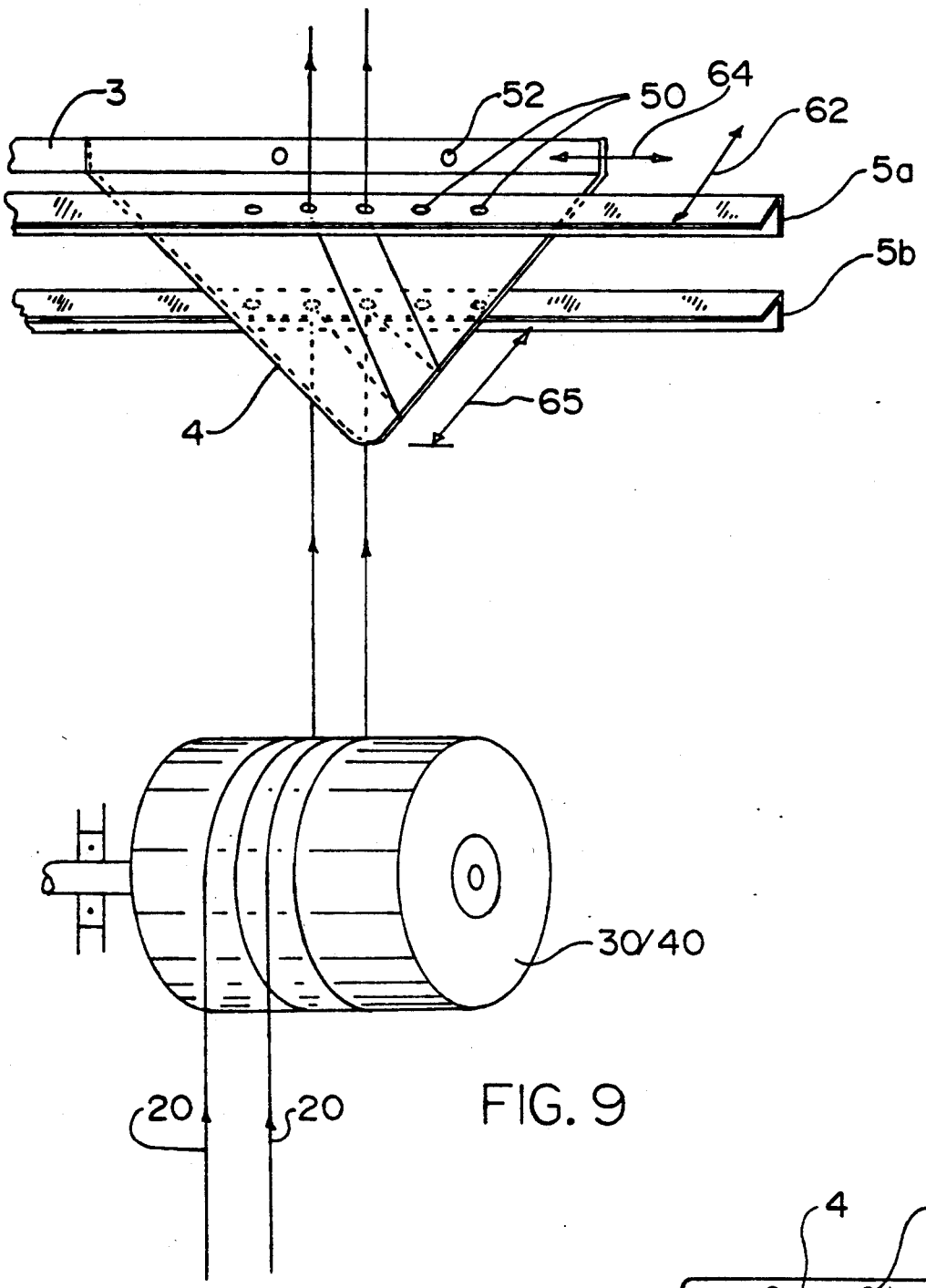
FIG. 9 Detail of yarn guide/triangle interaction.

FIG. 9 shows the interaction of the triangle and the yarn strand vis a vis the guides. The lower portion of the moving strand is below the triangle in connection with the lower yarn guide 5B and cannot be seen. The strand is shown emerging from underneath the triangle and heading toward another set of guide holes in the upper yarn guide. The yarn guides come in pairs—an upper guide 5A and a lower guide 5B. The figure also shows that as distance from the tip of the triangle to the guide is larger, more slack is created and longer slub lengths are produced. If this distance is smaller, shorter slub lengths are produced. This distance is determined by the length of travel (see arrow 65) of the profile 4 and thus, this distance determines the length of slub produced.

Thus, the use of the yarn guide allows one to vary the slub length. And the use of the moving triangular profiles enable one to vary the interval between slubs themselves by varying the timing of the cycle of movement of the profiles. There should be at least one yarn guide in connection with each feed roll, the apparatus would likely use at least two feed rolls.

The yarn guides move in a back and forth movement and contact the strand all the time through the holes 50. I.e. each guide moves furthest in one direction and then moves furthest in the opposite direction, see FIG. 9. With each movement of the yarn guide, the guide will bring the strand into contact with the triangular profile 4 and slack will be induced in the strand. The guides do not have to be exactly 180° out of phase for the invention to work, but they may be set at various phase intervals apart from one another.

Each yarn guide moves side to side in the side view shown in FIG. 2 and the rods and attached triangular profile would move from front to back if one were standing in front of the machine. Note that the movement of the guides 5, see arrow 64, is at right angles to that of the triangular profiles, see arrows 62, those would typically be moving left to right as one views the machine from the front. The arrows in FIG. 9 also show these movements.

The guides are connected to a driving means 7 that imparts reciprocal movement to the guides. In the arrangement shown in FIG. 2 the drive motor turns in circular fashion which is converted to linear reciprocal movement through a rod arrangement. While that shown is one method, there are, of course, other arrangements that could be used to produce the necessary linear reciprocal movement of the yarn guides.

The yarn guides are mounted on a pivoting means 10 in order to insure that the yarn guides are moving in direction opposite one another at all times. While the pivoting means is one method, there are, of course, other means to insure that rods are moving in different directions. There is no requirement that the rods must both be in connection with each other through a pivoting means, the yarn guides may be separately mounted.

Figure 6:
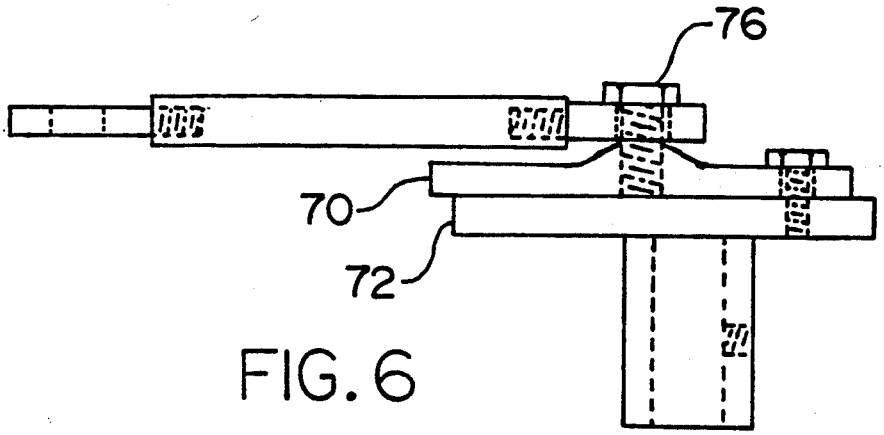
FIG. 6 Side view of yarn guide drive.
Figure 7:
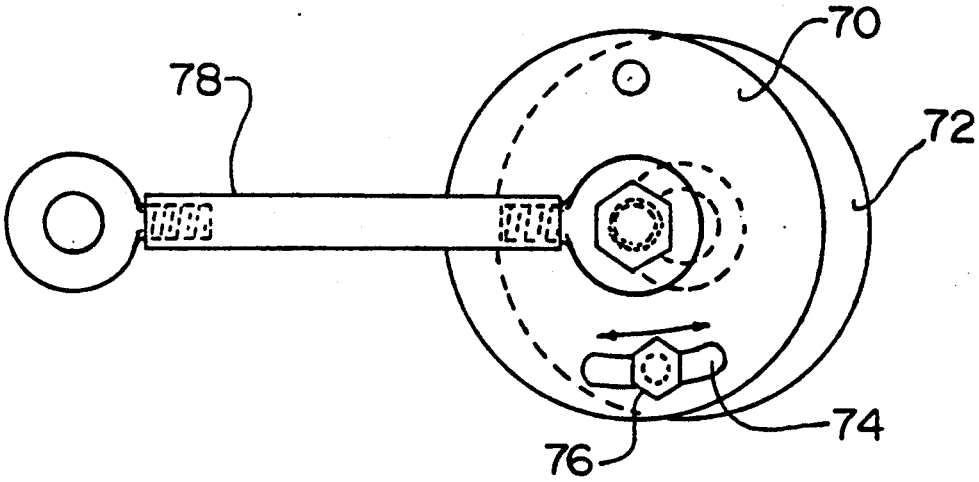
FIG. 7 Top view of yarn guide drive.
Figure 8:
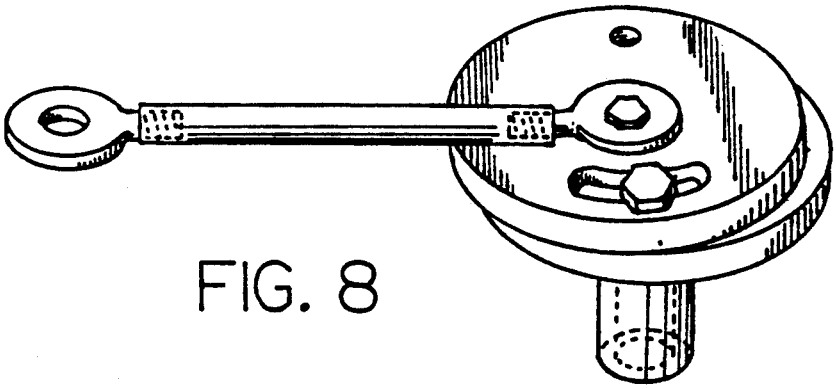
FIG. 8 Perspective view of yarn guide drive.

The use of the drive rod and pin arrangement allows one to vary the length that each yarn guide moves and so vary the period for each cycle of the yarn guide see FIGS. 6-8. An upper disk 70 and lower disc 72 are arranged upon one another. The placement of the discs vis a vis each other may be varied by the screw 76 and adjustment slot 74. This will change the amount of travel of the engagement rod 78 and thereby vary the distance that the yarn guides travel. The rod 78 is connected to the traverse device 6. By varying the period, one may vary the slub lengths produced. There could be any number of ways of arranging the driving means to vary the length of the yarn guide movement, that shown is one method.

Feed rolls 30 and 40 are mounted usually above and below one another in a working yarn processing machine. Typical yarns that could be used in the present invention include continuous filament yarns such as: polyester, nylon, polypropylene, acetate, rayon, fiberglass as well as staple yarns.

Note that by making changes in the shape of the triangular profiles other effects may be produced.

I claim:

1. An apparatus for creating special effects in yarn during processing operations comprising: first and second feed roll means, each of the feed rolls having at least one strand of yarn in connection therewith so as to have first and second feed strands associated with said first and second feed rolls respectively, take up roll located downstream and in connection with said first and second feed strands for taking up the finished feed strands so as to cause said feed strands to move from said feed roll to said take up roll, an air jet means for texturizing said first and second feed strands, said air jet means located between said feed rolls and said take up roll, a first and second strand guide means in connection with said first and second feed strands respectively, each of the strand guide means in connection with a first means for imparting a period of reciprocal motion to each of the strand guide means, a first and second triangular portion, each of said triangular portions in connection with a second means for imparting reciprocal motion to each of said triangular portions so that said triangular portions move back and forth a predetermined distance, each of the strand guide means moves each of the feed strands into contact with one of said triangular portions for imparting slack in the feed strands as the feed strands enter said jet to thereby create slub lengths.

2. The apparatus of claim 1 where each of said feed strands has two strands of yarn in associated therewith.

3. The apparatus of claim 2 having a means for varying the period of reciprocal motion of the first means for imparting reciprocal motion to each said strand guide means for varying the distance between said slub lengths.

4. The apparatus of claim 3 having means to vary said distance that said triangular portions move in connection with the second reciprocal motion means for varying the length of said slub lengths.

* * * * *